US005761867A

United States Patent [19]

Carling

[11] Patent Number: 5,761,867

[45] Date of Patent: Jun. 9, 1998

[54] TILE SUPPORT INSERT

[75] Inventor: Jason Carling, Salt Lake City, Utah

[73] Assignee: Sport Court, Inc., Salt Lake City, Utah

[21] Appl. No.: 729,502

[22] Filed: Oct. 11, 1996

[51] Int. Cl.[6] ..... E04F 15/10

[52] U.S. Cl. ..... 52/386; 52/384; 52/177

[58] Field of Search ..... 52/177, 403.1, 52/480, 181, 384, 386; 248/633, 638, 645, 678

[56] References Cited

U.S. PATENT DOCUMENTS

| | | | |
|---|---|---|---|
| D. 255,744 | 7/1980 | Dekko . | |
| D. 274,588 | 7/1984 | Swanson et al. . | |
| 3,438,312 | 4/1969 | Becker et al. . | |
| 3,802,144 | 4/1974 | Spica | 52/177 X |
| 3,909,996 | 10/1975 | Ettlinger, Jr. et al. | 52/177 |
| 3,946,529 | 3/1976 | Chevaux . | |
| 4,008,548 | 2/1977 | Leclerc | 52/180 |
| 4,167,599 | 9/1979 | Nissinen | 52/177 X |
| 4,226,064 | 10/1980 | Kraayenhof | 52/180 |
| 4,287,693 | 9/1981 | Collette . | |
| 4,338,758 | 7/1982 | Hagbjer | 52/403.1 X |
| 4,361,614 | 11/1982 | Moffitt, Jr. | 52/177 X |
| 4,436,779 | 3/1984 | Menconi et al. . | |
| 4,468,910 | 9/1984 | Morrison . | |
| 4,478,901 | 10/1984 | Dickens et al. . | |
| 4,584,221 | 4/1986 | Küng | 52/177 X |
| 4,807,412 | 2/1989 | Frederiksen | 52/177 |
| 4,860,510 | 8/1989 | Kotler | 52/177 |
| 4,930,286 | 6/1990 | Kotler | 52/177 |
| 4,948,116 | 8/1990 | Vaux . | |
| 5,253,464 | 10/1993 | Nilsen . | |
| 5,323,575 | 6/1994 | Yeh | 52/177 |
| 5,403,637 | 4/1995 | Pickard et al. | 52/177 X |
| 5,509,244 | 4/1996 | Bentzon | 52/586.1 X |

*Primary Examiner*—Christopher Kent
*Assistant Examiner*—Yvonne Horton-Richardson
*Attorney, Agent, or Firm*—Thorpe, North & Western

[57] ABSTRACT

A tile support insert of the present invention is used with a conventional tile having an upper portion formed by a plurality of intersecting cross members, and a lower portion formed by a plurality of spaced support legs. The tile support insert has a core plate with a plurality of openings formed therein for receiving support legs of a conventional tile. The insert prevents the support legs from deforming when a heavy, localized load is placed on the tile. The tile support insert will typically extend upwardly a sufficient distance also to support the interconnecting cross members which form the upper surface of tile. When nested together, the tile and the tile support insert can form a generally contiguous tile which dramatically increases the load bearing capacity of the tile.

23 Claims, 7 Drawing Sheets

TILE SUPPORT INSERT

BACKGROUND OF THE INVENTION

1. Field of the Invention

The present invention relates to a tile support insert for use in modular flooring assemblies such as those used for athletic play areas. More particularly, the present invention is related to a tile support insert used in modular flooring assemblies which improves the ability of the tiles of the flooring assembly to handle large, localized point loads without damaging the tiles.

2. State of the Art

Numerous types of floorings have been used to create playing areas for sports, such as basketball, roller hockey and tennis, as well as for other purposes. Common flooring assemblies include a wide range of materials, such as concrete, asphalt, wood and other materials. For each type of flooring, there are corresponding advantages and disadvantages. For example, concrete and asphalt floorings are easy to construct and provides long term wear. However, concrete and asphalt floors provide no "give" during use and many people are injured each year during sporting events due to falls and other mishaps.

In contrast, there are flooring assemblies, such as wood which have an appropriate amount of give to avoid such injuries. It is for this reason that such floorings are used for basketball courts and the like. The wood floors, however, are expensive to install and require continued maintenance to keep them in good condition.

Due to these concerns, the use of modular flooring assemblies made of synthetic materials has grown in popularity. The synthetic floors are advantageous for several reasons. A first reason for the flooring assemblies' popularity is that they are typically formed of materials which are generally inexpensive and lightweight. If a tile is damaged it may easily be replaced. If the flooring needs to be temporarily removed, the individual tiles making up the floor can easily be detached, relocated, and then reattached to form a new floor in another location. Examples of modular flooring assemblies include U.S. Pat. Nos. Des. 274,588; 3,438,312; 3,909,996; 4,436,799; 4,008,548; 4,167,599; 4,226,064 and 255,744.

A second reason for the popularity of the flooring assemblies is that the durable plastics from which they are formed are long lasting. Unlike other long lasting alternatives, such as asphalt and concrete, the material is generally better at absorbing impacts, and there is less risk of injury if a person falls on the plastic material, as opposed to concrete or asphalt. The connections for the modular flooring assembly can even be specially engineered to absorb lateral force to avoid injuries, as is described in U.S. Pat. No. 4,930,286. Additionally, the flooring assemblies generally require little maintenance as compared to other flooring, such as wood.

One problem which has plagued the modular floor covering assemblies is that the tiles are generally unable to handle localized heavy loads without damage to the tile. This is especially true if the tile repeatedly is subjected to a heavy load in a localized spot or in repeated movement across the tile in one direction.

Referring now to FIG. 1A, there is shown a top view of a tile, generally indicated at 10 as is typically used in modular flooring surfaces. The tile 10 has an upper portion 14 which is formed by a plurality of intersecting cross members or ribs 16 with openings 18 disposed therebetween such that the cross members are arranged in a grid matrix.

The upper portion 14 has an upper surface 20 which provides a primary support to foot, vehicle and other types of traffic.

Referring now to FIG. 1B, there is shown a cross-sectional view of the conventional tile 10 of the prior art. The upper portion 14 of the tile 10 is supported above a base surface, such as concrete, by a plurality of support legs 22 which extend downwardly from the upper portion 14. The support legs 22 thus form a lower portion, generally indicated at 26. Each of the support legs 22 has a contact face **22*a* at a bottom end thereof for resting on a subfloor, such as concrete. The lower portion 26 defines a generally open cavity within a perimeter 28 of the floor tile and between a lower surface 16*a* of the grid matrix and a contacting surface of the subfloor 30. The only portion of the tile 10 which extends through the cavity is the support legs 22**.

The tile 10 shown is advantageous over other types of flooring, such as concrete and asphalt because it provides sufficient give to avoid many types of injury. Such tiles are advantageous over wood because they require little maintenance and are extremely durable. One disadvantage to such tiles, however, is that placement of a heavy load on a localized portion of the flooring surface 20 can overwhelm the ability of the support legs 22 at the location to support the tile 10. In such a case, it is common for the support legs 22 to buckle, bend or otherwise deform. Once deformed, the support leg 22 will always provide a weak spot within the tile 10 which interferes with the optimal performance of the tile. Additionally, if the load placed on a portion of the tile is too severe, it may even result in the ribs 16 cracking or deforming under the pressure.

Attempts to mitigate these concerns have achieved tiles, such as that shown in FIG. 2, in which the entire tile, generally indicated at 40, is made out of intersecting cross members or ribs 44. Those skilled in the art will appreciate that such tiles are often used outside. To ensure proper drainage, ports 48 must be placed in the ribs 44. The ports 48 inherently define support legs 52 in the lower portion of the ribs 44 at the point of intersection. While such an arrangement has been shown to be a significant improvement, the tile 40 can still suffer damage when heavy loads are placed thereon. The damage may be either deformation of the support legs 52, or of the ribs 44 above the ports 48.

Thus, there is a need for a flooring assembly which improves the ability of flooring tiles to withstand heavy loads without deforming or otherwise damaging the cross members or the support legs. Such an assembly should be lightweight, relatively inexpensive and made to work with flooring tiles of the prior art. Such an assembly should also be removable, and allow use with some tiles without affecting the overall look of a flooring assembly formed by joining numerous tiles.

SUMMARY OF THE INVENTION

Thus, it is an object of the present invention to provide a tile support which may be used with modular tile flooring assemblies to prevent damage to the tiles by heavy, localized loads.

It is another object of the present invention to provide such a tile support which may be used with existing tile flooring assemblies and which may be used without substantially changing the appearance of the flooring assembly.

It is another object of the present invention to provide such a tile support which is inexpensive to manufacture and easy to use.

It is still another object of the present invention to provide such a tile support which is removable from the flooring assembly and a surface on which the flooring assembly is placed so as to enable removal of the tile support when use of the support is not desired.

The above and other objects of the invention not specifically enumerated are realized in specific illustrated embodiments of a tile support including a support insert having a plurality of openings formed therein for receiving support legs of a conventional tile. The support insert will typically extend upwardly a sufficient distance to support the interconnecting cross members which form the grid matrix of the tile.

In accordance with one aspect of the invention, the support insert has a plurality of nubs which extend upwardly to fill the openings between the cross members of the grid matrix. The nubs are formed by providing a generally planar surface with a plurality of channels formed therein for receiving the cross members of the grid matrix. At the intersection of each channel, openings are formed for receiving the support legs which extend down at each intersection of the cross members of the tile.

In accordance with another aspect of the invention, the support insert extends upwardly only so far as to contact the lower surface of the cross members of the grid complex in order to provide support without filling the openings between the cross members.

In accordance with yet another aspect of the invention, the support inserts are made for each tile of the prior art and are formed as negative images of the tile so that nesting the tile insert into the cavity of the tile forms a generally continuous tile for whatever portion of the conventional tile is nested within the insert.

In accordance with another aspect of the present invention, the voids in the support insert extend through the support insert so that the support legs of a tile nested in the support structure extend to a position at least coextensive with a bottom surface of the support insert.

In accordance with still another aspect of the present invention, the support insert is formed so as to leave a small space between the tile and the support insert when the tile is placed in the support insert to thereby allow for give within the tile while simultaneously preventing damage by large, localized loads.

In use, a tile is selected having a known configuration for the grid matrix formed by the intersecting cross members and for the positions and size of the support legs which hold the grid matrix above a subfloor. The tile is then matched to a tile insert which has openings/voids for receiving the support legs. The tile insert is then nested into the cavity so that the support legs nest in the openings/voids. The tile insert is typically advanced until it contacts the grid matrix. The combined tile and tile insert are then placed in a floor assembly in the same manner as the tile would be if no insert were present. While, depending on the embodiment of the insert chosen, the conventional tile may be provided with a generally planar surface, the appearance of the tile is otherwise unaffected and the tile does not look out of place in the conventional flooring assembly, even if only some of the tiles are provided with support inserts. At the same time, the tiles with the insert provide a flooring assembly which is better able to handle heavy, localized loads.

Yet another aspect of the invention involves the use of an insert which is thicker than the tile which is supported, thereby holding the tile above the flooring surface. In such a manner, irregularities in the flooring surface may be filled by the insert to provide generally consistent support under the tile. Likewise, the flooring assembly can be raised by the insert to delineate boundaries or to provide other indications as to borders.

Still another aspect of the present invention involves the use of an insert sized to fill part of the tile to be supported. In such a manner, a particular area of a tile which is subjected to heavy loads may be supported, while excess insert is not used to support less burdened areas of the tile.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1A:
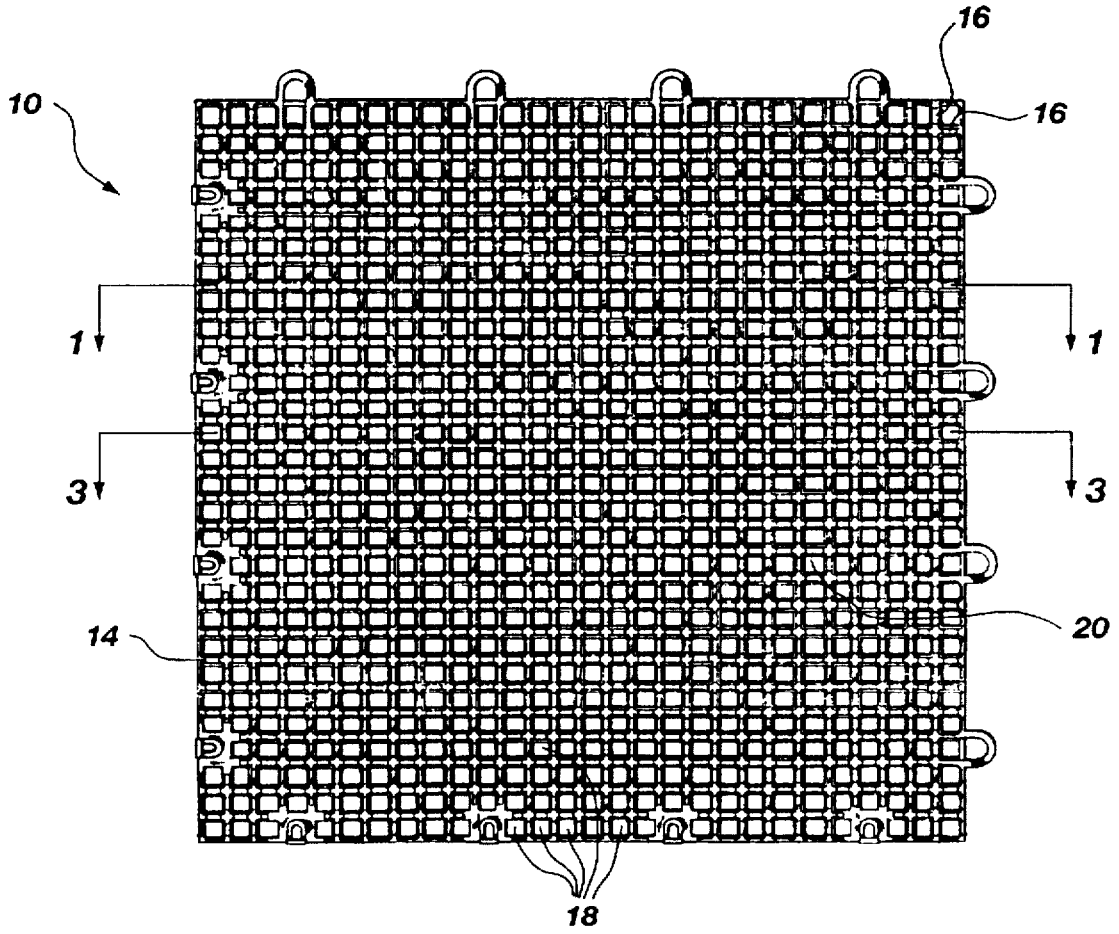
Fig. 1A (PRIOR ART)
FIG. 1A shows a top view of a conventional tile for use in modular flooring assemblies.
Figure 1B:
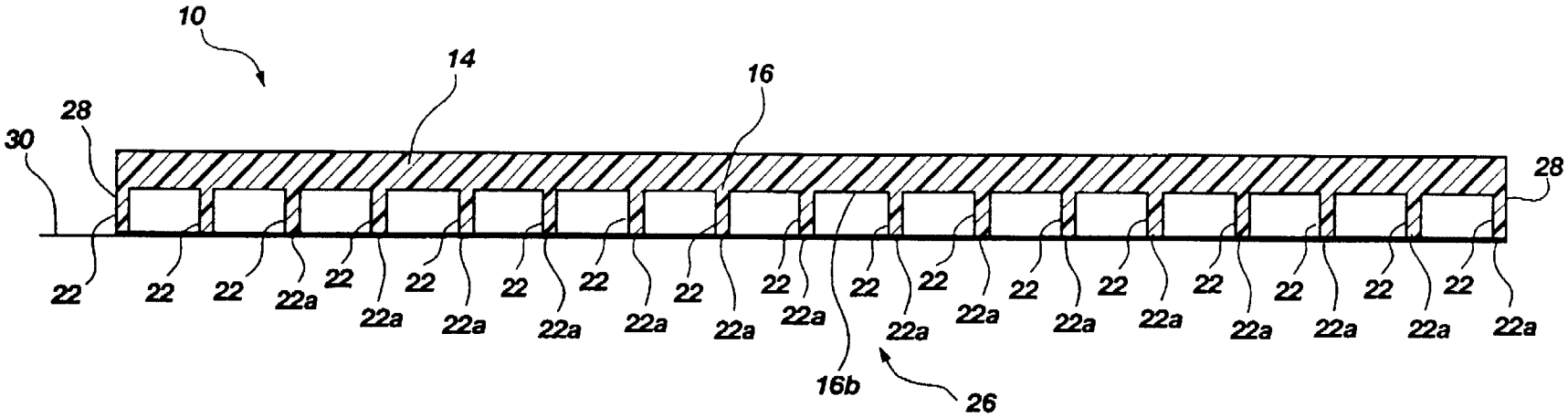
Fig. 1B (PRIOR ART)
FIG. 1B shows a cross-sectional view of the tile made in accordance with the teachings of the prior art taken along the line 1—1 of FIG. 1A.
Figure 2:
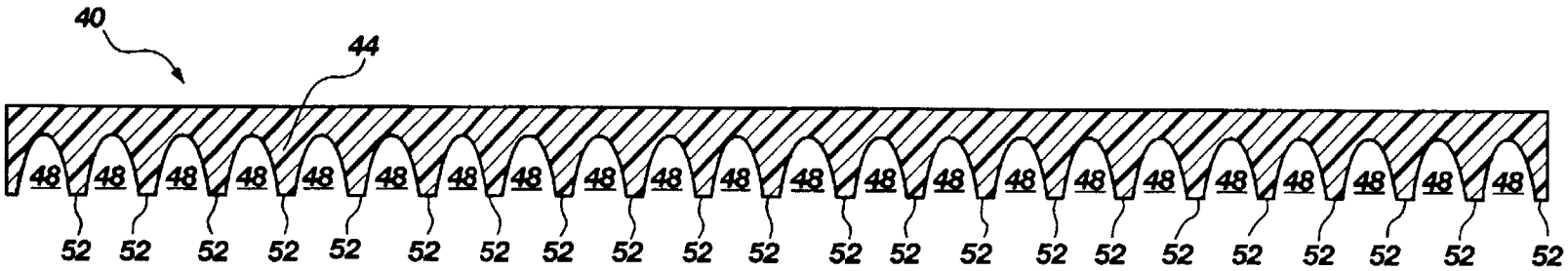
Fig. 2 (PRIOR ART)
FIG. 2 shows a cross-sectional view of another tile made in accordance with the teachings of the prior art.
Figure 3:
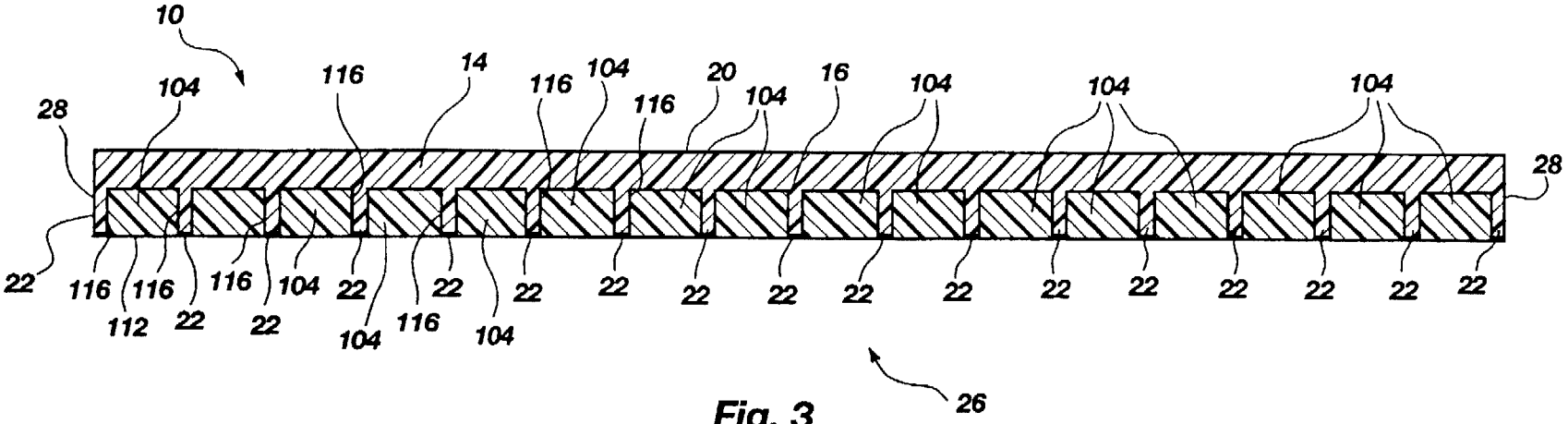
FIG. 3 shows a cross-sectional view of the tile of FIG. 1B, and a support insert for decreasing the susceptibility of the tile to damage due to localized heavy loads.

Referring to FIG. 3, there is shown a cross sectional view of the conventional tile 10 shown in FIGS. 1A and 1B. The tile 10 include the upper portion 14 which is formed by intersecting cross members or ribs 16, only one of which is shown due to the cross-sectional view. Extending downwardly from the cross members 16 into the cavity disposed therebelow are a plurality of support legs 22. To provide additional support to the tile 10, a support insert, generally indicated at 100, is nested into the cavity below the cross members 16 of the grid matrix.

The support insert 100 includes a core plate 104 which is configured for insertion within the open cavity. The core plate 104 has a top surface 108 (FIG. 3A) and a bottom surface 112. Due to the cross-section through the support legs 22, the core plate 104 appears to be noncontiguous in FIG. 3. However, in FIG. 3A, there is shown an alternate cross-sectional view which shows the generally contiguous nature of the core plate 104.

The core plate 104 has a plurality of openings or voids 116 into which the support legs 22 of the flooring tile 10 can rest. Openings or voids 116 are used because the portion which receives the support legs needs not extend all the way through the core plate, although such is believed to be a preferred embodiment. In the alternative to an opening, the void could extend down to a position adjacent the lower surface 112 of the core plate 104 without actually penetrating through the core plate.

The core plate 104, will is typically be made out of a rigid polymer material similar to that used for the tile 10. The material is preferably a substantially rigid polymer which is lightweight and provides a small amount of give both laterally and vertically.

Figure 3A:
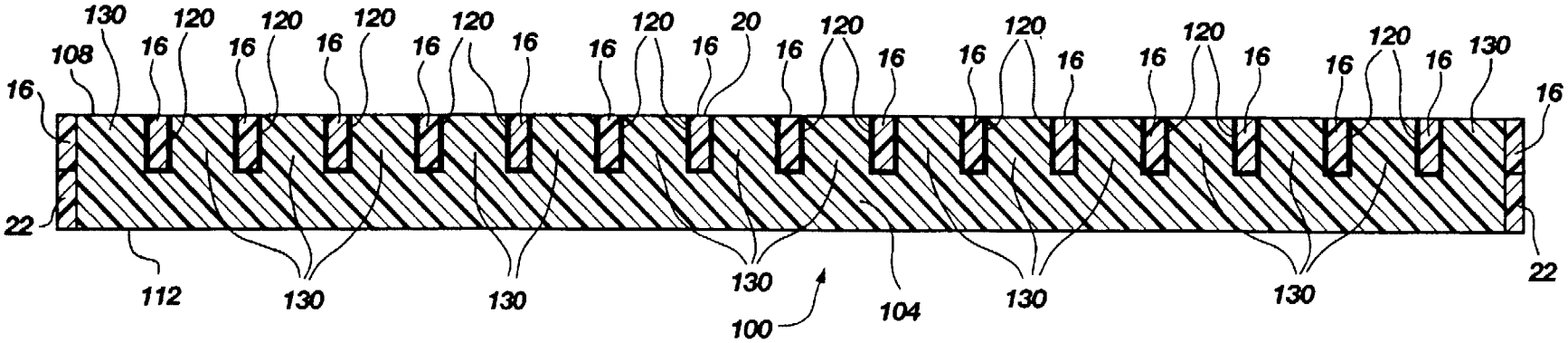
FIG. 3A shows a cross-sectional view of the tile and support insert taken through the line 3—3 shown in FIG. 1A.

As shown in FIG. 3A, the upper surface 108 of the core plate 104 extends up to approximately the same height as the surface 20 of the grid matrix as formed by the cross members 16. A plurality of channels 120 are formed in the upper surface 108 of the core plate 104 to divide the upper surface of the core plate into a plurality of nubs 130 which fit snugly within the openings 18 (FIG. 1A) between the cross members 16 of the grid matrix. It is presently believed that a preferred embodiment is for the channels 120 and openings 116 to be sufficiently small that the cross members 16 and support legs 22 of the tile 10 nest snugly therein. In other words, the outer circumference or dimensions of the support legs will be only slightly smaller than the inner circumference/dimensions of the openings 116. Likewise, the width of the channels 120 will be only slightly larger than that of the cross members. Thus, the core plate 104 adds lateral stability.

The embodiment shown in FIG. 3A is advantageous in that it essentially forms one contiguous tile. The tile 10 is better able to handle extreme weights such as, for example, an automobile being driven thereon. It will be appreciated that such an embodiment will typically only be used in areas which require tiles without give.

Figure 3B:
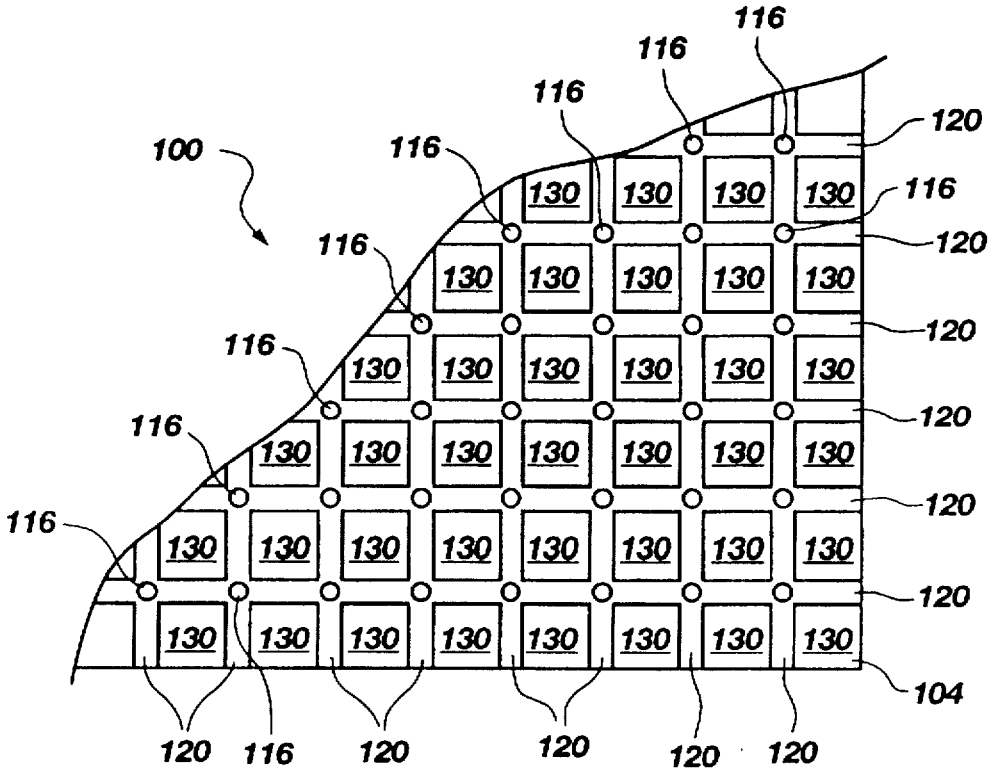
FIG. 3B shows a fragmented, top plan view of the support insert shown in FIGS. 3 and 3A.

Referring now to FIG. 3B, there is shown a fragmented, plan view of the core plate 104 shown in FIG. 3A. Because the support legs 22 of the tiles 10 are generally disposed at the intersection of two cross members, the channels 120 which receive the cross members 16 run into the openings 116 which receive the support legs. The channels 120 define the nubs 130 which will slide into the openings 18 (FIG. 1A) in the tile 10 so as to form a tile which is substantially contiguous.

When the tile 10 is nested in the support insert 104, a superior tile is achieved for the purposes of withstanding heavy, localized loads. One significant advantage of the present invention is that an area of a modular flooring assembly may be protected while maintaining a consistent appearance along the traffic bearing surface 20 of the tiles 10. If, for example, a basketball court is formed from the tiles and large equipment is to be used filming those playing on the court, the core plates 104 can be disposed in the tiles 10 around the boarder of the court. By having the tiles about the boarder of the court supported, the equipment can be moved without damaging the tile and without disrupting the continuity of the appearance of the flooring surface. The only difference is that the tiles around the boarder will have a generally continuous surface. By using different color inserts, the boarder of the playing area can be emphasized. In the alternative, the nubs 130 could be made to extend only partially into the openings 18 (FIG. 1A) in the tile 10, thereby allowing a slight amount of give and providing a non-continuous surface 20 to the tile.

Figure 4:
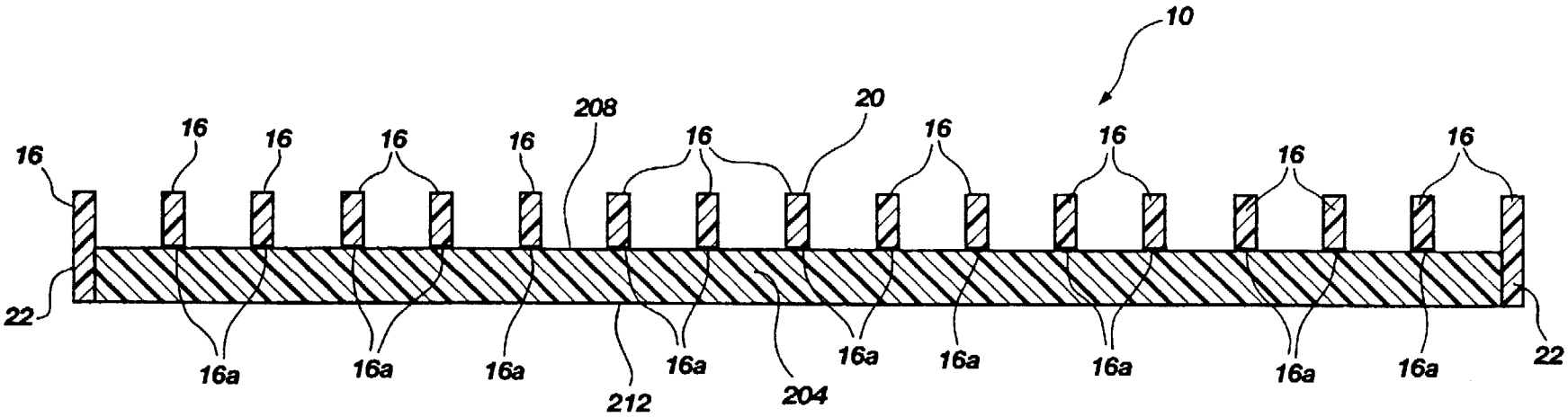
FIG. 4 shows a cross-sectional view of the tile and an alternate embodiment of the support insert taken through the line 3—3 shown in FIG. 1A.

Referring now to FIG. 4, there is shown a cross-sectional view of an alternate embodiment of the present invention. The tile 10 is formed in a similar manner as the tile as shown in FIGS. 1A, 1B and 3A. The core plate 204 is different than that shown in FIG. 3–3B in that it does not extend up to the flooring surface 20. Rather, the upper surface 208 extends up to a lower end **16*a* of the cross members 16 which form the grid matrix. Thus, the tile 10 is substantially solid below the grid matrix when the support legs 22 (FIG. 3) are nested in the openings 116 (FIG. 3) of the core plate 204, thereby replacing the substantially open cavity of a conventional tiles which is interrupted only by the support legs. When pressure is placed on the tile, it is conveyed through the support legs 22 to a subfloor, not shown. When a large load is placed on the tile 10, the load will be carried not only by the support legs, but also by the core plate 204**.

The core plate 204 provides a significant amount of support to the tile 10. However, unlike the embodiment shown in FIG. 3A, the tile is allowed to displace laterally because the lack of the nubs 130 (FIG. 3A) disposed between the cross members 16. Such a configuration will typically be used where the tile 10 is subjected to moderately heavy loads, but where some lateral and/or vertical movement is still desired. An example may be a playing surface which has moderately heavy equipment rolled on it occasionally. Lateral give is preserved for those using the surface for sports, but damage due to the equipment is avoided.

Figure 5:
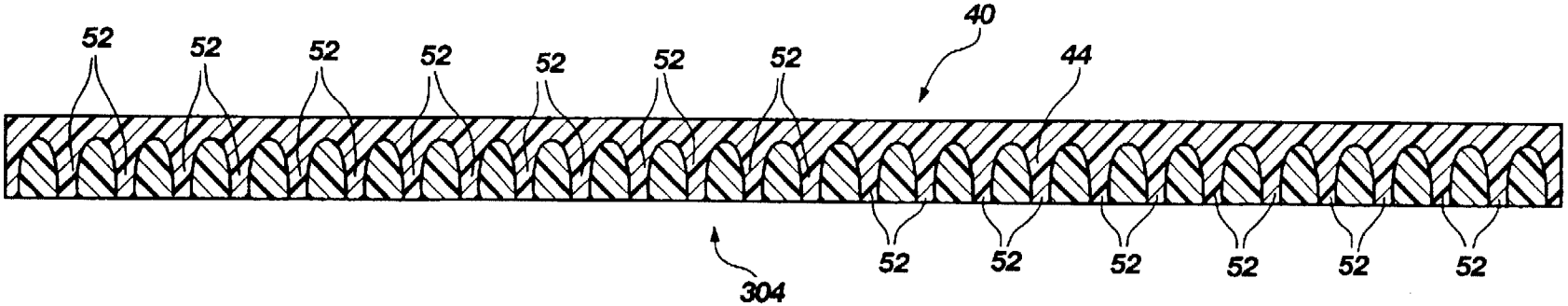
FIG. 5 shows a cross-sectional view of the tile of FIG. 2, and a support insert made in accordance with the principles of the present invention.

Referring now to FIG. 5, there is shown an alternate embodiment of the core plate, generally indicated at 304, nested in the tile 40. FIG. 5 is shown primarily to demonstrate that the core plate 304 can be molded to fit the variety of different configurations presently used in modular flooring assembly tiles. For virtually all of the configurations currently in use, a core plate 304 may be made by using one of the tiles as a mold and forming a negative or reverse image of at least the cavity of the tile 10. The core plate 304 can have arcuate sections, rectangular sections, or any other shape commonly used. If nubs, such as those indicated at 130 in FIG. 3A are not desired, the area between the cross members 16 can be filled with any suitable material for limiting the initial molded core plate to the depth desired. Of course, other fillers could be used to tailor the core plate 104, 204, or 304 to a particular purpose. For example, a filler could be formed so that the majority of material forming the core plate is disposed immediately around the openings 120, while an indentation is provided instead of the nubs 130 (FIGS. 3A–3B), thereby decreasing the overall weight of the core plate while still providing a substantial amount of protection to the support legs 22.

Figure 6:
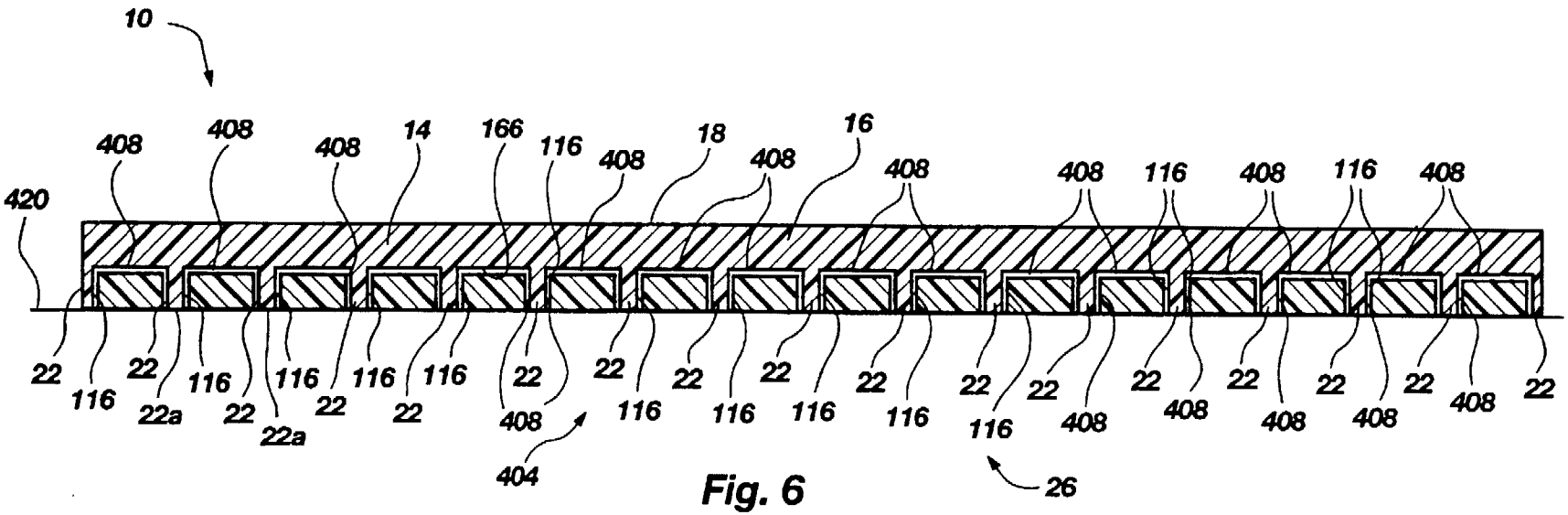
FIG. 6 shows a cross-sectional view of a tile and an alternate embodiments of a support insert made in accordance with the principles of the present invention.

Referring now to FIG. 6, there is shown an alternate embodiment of the present invention. By placing a filler material on all of the surfaces to be received by the core plate 404, i.e. the support legs 22 and the lower end **16*a* of the cross members 16, a small gap 408 can be created at each interface between the core plate 404 and the tile 10. The small space 408 allows the tile 10 to give slightly both laterally and vertically. However, the tile 10 is able to give sufficiently that the tile is not damaged by even a large, localized load. Rather, before the cross members 16 or support legs 22 can deform sufficiently to cause damage, they will contact the core plate 404 which significantly limits further movement. The size of the spacings between the structures of the tile 10 and those of the core plate 404** can be adjusted to achieve a desired balance of give characteristics and tile support.

While in the figures the sides of the cross members 16, support legs 22, openings 116 and channels 120 all appear substantially vertical, those skilled in the art will appreciate that each usually has a small draft. The draft facilitates formation of the tile 10 and the core plate 104 or 204 during the molding process. The interaction of the drafts between, for example, the cross members 16 and the channels 120 (FIGS. 3–3B) helps to maintain a secure fit between the tile 10 and the core plate 104 or 204.

Figure 7:
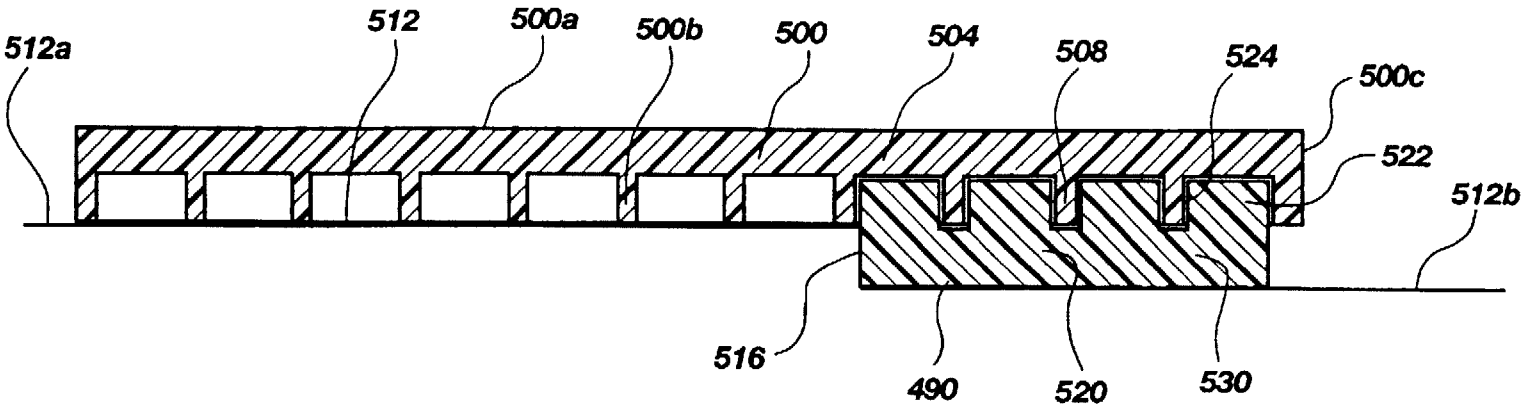
FIG. 7 shows yet another cross-sectional view of a tile and support insert made in accordance with the principles of the present invention.

Referring now to FIG. 7, there is shown a cross-sectional view of still additional aspects of the invention. A tile 500 has an upper portion 500*a* which is formed by a plurality of intersecting ribs 504, and a lower section 500*b* which is formed by a plurality of support legs 508 which extend downwardly from the intersecting ribs. As shown in FIG. 7, the tile 500 is disposed so that the support legs 508 contact an upper portion 512*a* of a flooring surface. Adjacent one end of the tile 500*c*, the flooring surface 512 has a ledge 516 which drops to a lower portion 512*b* of the flooring surface. If a regular flooring tile where disposed over such a ledge 516 or otherwise irregular surface, the lack of support would lead to premature failure of the tile due to flexing each time the overhanging portion of the tile was placed under load. To prevent the tile 500 from being damaged, a support insert 490 formed by a small piece of a core plate 520 is placed under the overhanging portion of the tile 500. The core plate 520 has an upper portion 522 which is configured with a plurality of voids 524 for receiving the support legs 508 of the tile 500. Those skilled in the art will appreciate the voids 524 can be configured for support legs of any cross-sectional shape, and/or for intersecting ribs should support legs be omitted.

The core plate 520 also has lower portion 530 for resting on the flooring surface. If necessary, the lower portion 530 could be configured to fill a void in the flooring surface, or could be made to simply provide additional support over a void which cannot easily be filled. By changing the thickness of the lower portion 530, the core plate 520 can be used to adjust the height at which the tile 500 rests above the floor. The exact thickness of the core plate will depend largely on the contemplated uses thereof.

While shown in FIG. 7 as a device for filling an uneven flooring surface 512, a core plate 520 which is smaller than the tile 500 has several other uses. For example, if one side of a tile will be subjected to large rolling loads, such as is common with floors disposed under collapsible bleachers in basketball arenas, only the portion of the tile which is rolled over by the wheels supporting the bleachers needs to be supported. Thus, an insert need only be disposed under that portion which will be subjected to heavy loads. By configuring the core plate 520 smaller than the tile 500, i.e. the core plate being dimensioned in at least one direction so as to not extend within the open cavity to the perimeter of the tile, considerable material may be saved while appropriately supporting the tile.

Numerous modifications may be made to the invention as disclosed above. For example, adhesive could be placed between the tile support insert and the tile to bond the to together. Likewise, some sort of cushioning material could be used to allow a slight amount of give which preventing excessive deformation of the tiles.

Thus, there is disclosed a tile support insert which improves the ability of modular tile flooring assembly to withstand heavy, localized loads. Those skilled in the art will recognize numerous other modifications which can be made without departing from the scope and spirit of the present invention. The appended claims are intended to cover such modifications.

What is claimed is:

1. A support insert for use with a grid floor tile wherein the floor tile comprises (i) a grid matrix having intersecting cross members for forming a traffic bearing surface which provides primary support to foot traffic, (ii) an array of support legs extending down from the intersecting cross members, said support legs having a contacting face at a bottom end of each leg, and (iii) an open cavity within a perimeter of the floor tile and between a lower surface of the grid matrix and a contacting surface of a subfloor, said open cavity being laterally defined by said grid matrix and the support legs, said support insert comprising:

a core plate configured for insertion within the open cavity and having a top surface and a bottom surface and being formed of rigid polymer material;

said core plate including a plurality of openings extending from the top surface to the bottom surface, each of said openings being shaped and positioned within the core plate to receive one of the support legs in a constraining manner which limits lateral movement of the leg when the leg is nested within the opening;

said top surface of the core plate being configured for abutting contact at a bottom edge of the intersecting cross members to enable transfer of load through the floor tile and into the support insert; and a lower end of the plurality of openings being contained within a single plane.

2. An insert as defined in claim 1, further comprising a floor tile having (i) a grid matrix with intersecting cross members which provide primary support to foot traffic, (ii) an array of support legs extending down from the intersecting cross members, said support legs having a contacting face at a bottom end of each leg, and (iii) an open cavity within a perimeter of the floor tile and between a lower surface of the grid matrix and a contacting surface of a subfloor, said open cavity being laterally defined by said grid matrix and the support legs, said support insert being seated within the floor tile.

3. An insert as defined in claim 1, wherein the core plate is configured to match a reverse image of the open cavity.

4. An insert as defined in claim 1, wherein the floor tile includes a perimeter side wall surrounding the grid matrix, said core plate being dimensioned to extend within the open cavity to the perimeter side wall to fill the open cavity.

5. An insert as defined in claim 1, wherein the cross members comprise a vertical wall section.

6. An insert as defined in claim 1, wherein the core insert comprises a polymer.

7. An insert as defined in claim 1, wherein the floor tile includes a perimeter side wall surrounding the grid matrix, said core plate being dimensioned in at least one direction so as to not extend within the open cavity to the perimeter side wall to fill only a portion of the open cavity.

8. A support insert for nesting in a conventional tile of a modular flooring assembly, wherein the tile includes an upper portion having plurality of intersecting cross members for forming a traffic bearing surface and a lower portion having a cavity with a plurality of support legs disposed therein, the support legs extending downwardly from the intersecting cross members of the upper portion so as to support the cross members above the cavity, the insert comprising:

a core plate having an upper surface and a lower surface and configured for nesting within the cavity in the lower portion of the tile so as to substantially fill the cavity, the core plate having:

a plurality of openings/voids disposed therein and disposed for receiving the support legs of the tile such that placing the support legs within the openings/voids nests the core plate within the cavity in the lower portion, the openings/voids extending downwardly to a position adjacent the lower surface of the core plate and being sized so as to limit lateral movement of the support legs of the tile when the support legs are nested in the openings/voids; and support means disposed adjacent the cross members of the upper portion of the conventional tile for limiting movement of the cross members when a load is placed thereon.

9. The insert support of claim 8, wherein the support means comprises a generally planar upper surface of the core plate, the core plate being of sufficient thickness that the upper surface of the core plate contacts the cross members of the tile.

10. The insert support of claim 8, wherein cross members of the conventional tile intersect so as to form a plurality of openings in the upper portion of the conventional tile, and wherein the support means of the tile support insert further comprises a plurality of nubs extending upwardly and configured to at least partially fill the openings in the upper portion of the conventional tile.

11. The insert support of claim 8, wherein the support means comprises a plurality of channels disposed in the core plate for receiving the cross members of the tile.

12. The insert support of claim 8, wherein the openings/voids of the core plate are sized so as to firmly contact the support legs of the conventional tile when the core plate is nested in the cavity of the conventional tile.

13. The insert support of claim 8, wherein the support legs of the conventional tile have a circumference, and wherein the openings/voids of the core plate have a circumference which is larger than the circumference of the support legs so as to provide a space between the support legs and the core plate when the core plate is nested within the cavity of the conventional tile.

14. The insert support of claim 8, wherein the cavity of the conventional tile has a height, and wherein the core plate has a thickness which is less than the height of the cavity so as to provided a space between the core plate and the cross members of the conventional tile when the support legs are disposed in the openings/voids.

15. The insert support of claim 8, wherein the openings/voids of the core plate comprise openings which extend from the upper surface to the lower surface of the core plate.

16. The insert support of claim 8, wherein the openings/voids of the core plate comprise voids which extend from the upper surface to a position adjacent the lower surface of the core plate.

17. A method for supporting a tile of a modular flooring assembly, the method comprising:

a) selecting a tile having (i) a perimeter; (ii) an upper portion formed by a plurality of intersecting cross members defining a plurality of openings in the upper portion of the tile; and (iii) a lower portion having a plurality of spaced support legs extending downwardly from the cross members, each support leg having a contact face at a lower end thereof;

b) selecting a tile support insert having a core plate having an upper surface and a lower surface and a plurality of openings/voids formed in the upper surface and extending to a position adjacent to the lower surface for receiving the support legs of the lower portion of the tile; and c) nesting the tile support insert within the lower portion of the tile such that the support legs nest in the openings/voids of the core plate.

18. The method of claim 17, wherein step (b) comprises, more specifically, selecting a tile support which has openings extending from the upper surface to the lower surface, and wherein step (c) comprises, more specifically, nesting the core plate within the lower portion of the tile sufficiently that the contact face of the support legs is disposed coplanarly with the lower surface of the core plate.

19. The method of claim 17, wherein step (c) further comprises, contacting the cross members of the tile with the core plate.

20. The method of claim 16, wherein step (b) further comprises, selecting a core plate having a plurality of channels formed therein for defining nubs and receiving the cross members of the plate.

21. The method of claim 20, wherein step (c) further comprises advancing the core plate within the tile so that the cross members are disposed in the channels of the core plate and so that the nubs of the core plate are disposed in the openings in upper portion of the tile.

22. A modular flooring assembly for placement on a subfloor, the assembly comprising:

at least one tile having an upper portion formed by a plurality of intersecting cross members and a lower portion having a cavity and a plurality of support legs extending downwardly from the cross members through the cavity so as to support the upper portion above the subfloor; and a generally solid core plate nestable within at least the cavity of the lower portion, the core plate having a plurality of openings formed therein and configured for receiving the support legs of the tile so as to limit lateral movement of the support legs when a load is placed on the tile.

23. A support insert for use with a grid floor tile for disposition on a subfloor, wherein the floor tile comprises (i) a grid matrix having intersecting cross members which provide primary support to foot traffic and (ii) a plurality of open cavities between the intersecting cross members, said support insert comprising:

a core plate configured for insertion within the open cavities and having a top surface and a bottom surface and being formed of rigid polymer material;

said core plate including a plurality of voids extending from the top surface toward the bottom surface, each of said voids being shaped and positioned within the core plate to receive one of the intersecting cross members in a constraining manner which limits lateral movement of the cross-members nested within the voids;

said top surface of the core plate being configured for extending into the voids between said intersecting cross members; and a lower end of the plurality of openings being contained within a single plane.

* * * * *